United States Patent [19]

Fitzmayer

[11] 4,223,194

[45] Sep. 16, 1980

[54] MICROWAVE OVEN WITH MEANS FOR MODIFYING ENERGY DISTRIBUTION THEREIN

[75] Inventor: Louis H. Fitzmayer, Louisville, Ky.

[73] Assignee: General Electric Company, Louisville, Ky.

[21] Appl. No.: 973,401

[22] Filed: Dec. 26, 1978

[51] Int. Cl.[2] ..... H05B 9/06

[52] U.S. Cl. ..... 219/10.55 F; 219/10.55 R

[58] Field of Search ..... 219/10.55 F, 10.55 R, 219/10.55 B, 10.55 M, 10.55 E

[56] References Cited

U.S. PATENT DOCUMENTS

| | | | |
|---|---|---|---|
| 2,961,520 | 11/1960 | Long | 219/10.55 F |
| 3,218,429 | 11/1965 | Lenart | 219/10.55 R |
| 3,591,751 | 7/1971 | Goltsos | 219/10.55 F |
| 3,740,514 | 6/1973 | Anderson | 219/10.55 F |

*Primary Examiner*—Arthur T. Grimley

*Attorney, Agent, or Firm*—Bernard J. Lacomis; Radford M. Reams

[57] ABSTRACT

A microwave oven with an electrically conductive surface such as a flat metal plate positioned parallel to the bottom of the oven cavity and spaced therefrom by approximately one tenth the wavelength in free space λa of the excitation microwave energy. The width of the plate is an odd multiple of a quarter wavelength (λa/4) and the depth is an even multiple of λa/4. Preferably the plate is spaced an odd multiple of λa/4 from the feed aperture at the top of the oven cavity. The edges of the plate are spaced from the vertical side walls of the oven cavity, at least in that region of the cavity where the microwave energy level would be greatest in the absence of the plate.

7 Claims, 4 Drawing Figures

MICROWAVE OVEN WITH MEANS FOR MODIFYING ENERGY DISTRIBUTION THEREIN

The present invention relates to a microwave cooking oven and specifically to an improvement thereof whereby uneven energy distribution within the oven cavity is modified for greater uniformity.

In a microwave oven cooking cavity, the spatial distribution of the microwave energy tends to be non-uniform. As a result, "hot spots" and "cold spots" are produced at different locations. For many types of foods, cooking results are unsatisfactory under such conditions because some portions of the food may be completely cooked while others are barely warmed. The problem becomes more severe with foods of low thermal conductivity which do not readily conduct heat from the areas which are heated by the microwave energy to those areas which are not. An example of a food falling within this class is cake. However, other foods frequently cooked in microwave ovens, such as meat, also produce unsatisfactory cooking results if the distribution of microwave energy within the oven cavity is not uniform.

One explanation for the non-uniform cooking pattern is that electromagnetic standing wave patterns, known as "modes", are set up within the cooking cavity. When a standing wave pattern is established, the intensities of the electric and magnetic fields vary greatly with position. The precise configuration of the standing wave or mode pattern is dependent at least upon the frequency of microwave energy used to excite the cavity and upon the dimensions of the cavity itself. It is possible to theoretically predict the particular mode patterns which may be present in the cavity, but actual experimental results are not always consistent with theory. This is particularly so in a countertop microwave oven operating at a frequency of 2450 MHz. Due to the relatively large number of theoretically possible modes, it is difficult to predict with certainty which of the modes will exist. The situation is further complicated by the differing loading effects of different types and quantities of food which may be placed in the cooking cavity.

A number of different approaches to altering the standing wave patterns have been tried in an effort to alleviate the problem of non-uniform energy distribution. The most common approach is the use of a device known as a "mode stirrer", which typically resembles a fan having metal blades. The mode stirrer rotates and may be placed either within the cooking cavity itself (usually protected by a cover constructed of a material transparent to microwaves) or, to conserve space within the cooking cavity, may be mounted within a recess formed in one of the cooking cavity walls, normally the top.

The function of the mode stirrer is to continually alter the mode pattern in the oven cavity. As a result of continually changing the mode pattern in the cavity, the "hot" and "cold" spots are continually shifted and, when averaged over a period of time, the energy distribution in the cavity is made more uniform.

Although the use of a mode stirrer has proven to improve energy distribution in the cavity, it has been found in practice that uneven energy distribution can still exist in the cavity. For example, depending on the characteristics of a particular cavity and the feed aperture used to inject the microwave energy into the cavity, it is possible to have a region at one side of the cavity at a significantly higher strength than exists on the opposite side. Uneven distribution can also occur in the front to back direction.

Another approach to achieving more uniform cooking of food load in the oven is to employ a rotating table on which the food load is placed. The theory is that as the food load is rotated through "hot" and "cold" spots in the mode pattern, the averaged heating of the food will result in relatively uniform cooking. While somewhat helpful to this end: in practice, the results depend on the particular mode pattern established in a given oven and on the nature of the food load. For example, a vertically polarized predominantly TE mode will not perform satisfactorily in cooking horizontally placed bacon strips despite the use of the rotating table. Moreover, a mode pattern that produces a low energy level in the center of the oven will cause the axial portion of the rotating food load to remain less well cooked than in the outer regions of the load which passes through higher energy regions in the cavity.

It is, therefore, an object of the present invention to provide means in a microwave oven that will serve to further improve the evenness of energy distribution in the oven cavity.

Thus, in accordance with the invention, means are provided in a microwave cooking oven to more evenly distribute the microwave energy in the oven cavity. Such means are adapted for use in an oven having a microwave energy source, an interior cooking cavity including top, bottom and vertical side walls and energy feed means including an aperture in the top wall for feeding microwave energy into the cavity. In particular, the improvement of the invention comprises a metallic, electrically conductive surface within the cavity space. The surface is oriented parallel to the bottom wall of the cavity and spaced therefrom by a distance approximately equal to one tenth the wavelength in free space ($\lambda a$) of the microwave energy. The edges of the surface being spaced from the vertical side walls at least in the region of the cavity where the microwave energy level would be highest in the absence of the conductive surface. In a preferred form of the invention, the surface comprises a flat plate having a lengthwise dimension approximately equal to an odd multiple of $\lambda a/4$ and a width approximately equal to an even multiple of $\lambda a/4$, the plate also being spaced an odd multiple of $\lambda a/4$ from the feed aperture in the top wall of the cavity.

Figure 1:
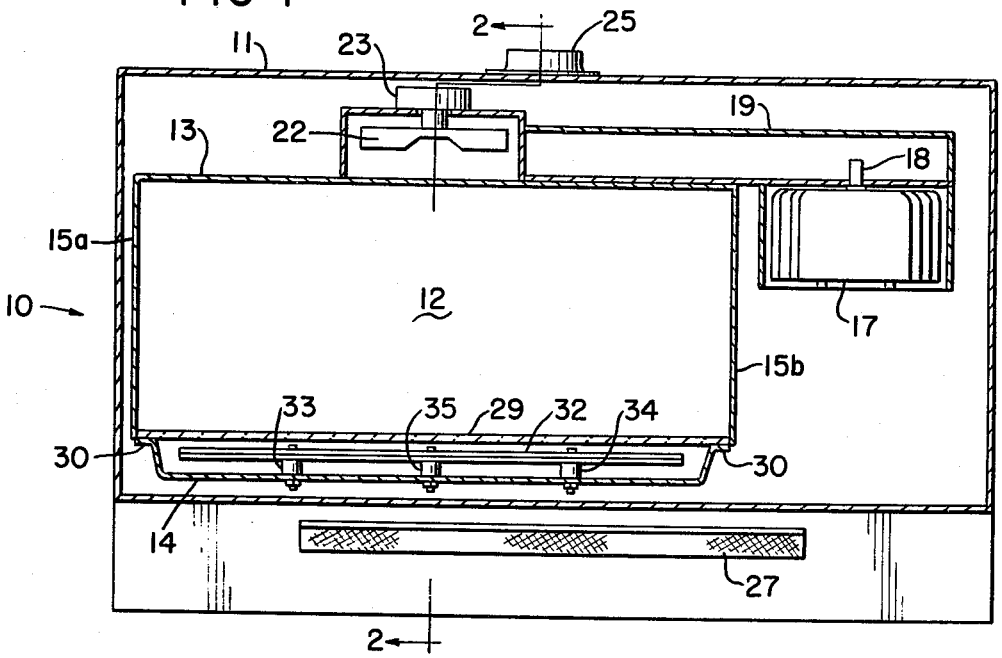
FIG. 1 is a front schematic view of a microwave oven illustrating the structure of the present invention.
Figure 2:
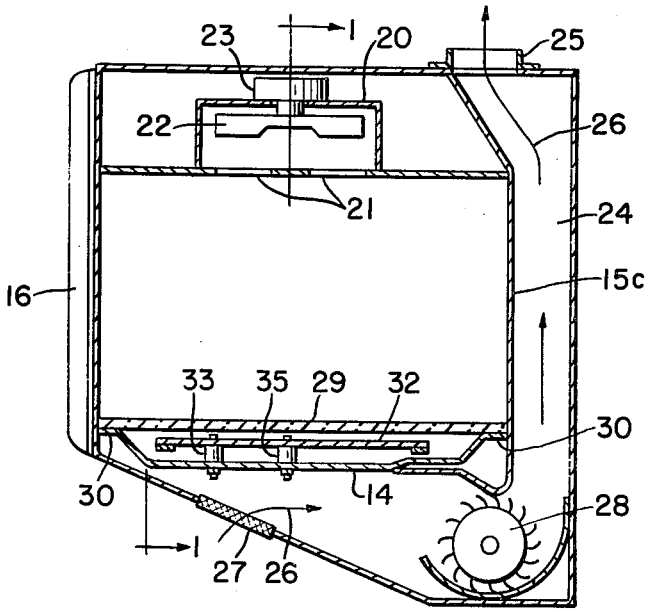
FIG. 2 is a side view of the FIG. 1 embodiment.

Referring to FIG. 1, there is shown in schematic form a microwave oven 10 comprising an outer casing 11 enclosing a cooking cavity 12 formed by top wall 13, bottom wall 14, and vertical side walls 15*a*–15*c*. The front of the cavity 12 is closed by door 16 (FIG. 2). A magnetron 17, powered by suitable control circuitry (not shown), generates microwave energy at a frequency of 2450 MHz having a wavelength in free space, $\lambda a$, of 4.82 inches which is coupled by a stub antenna 18 and waveguide 19 to a conventional feed box 20 mounted atop cavity 12 and from there through twin openings of feed aperture 21 into the oven cavity 12. A mode stirrer 22, powered by motor 23, may be included within feed box 20 to vary the excitation modes within cooking cavity 12 as described above in connection with the background of the invention.

The specific oven illustrated is designed to be mounted on the wall over a conventional cooking range and to serve the dual functions of microwave cooking and as an exhaust hood for the range. To this end, an air plenum 24 leads up the rear of the oven to an exhaust duct opening 25. As indicated by arrows 26, air is drawn into the vent arrangement through a filter grill 27, by means of a fan or blower 28 which forces the air up plenum 24. Within cavity 12 there is provided a glass-ceramic shelf 29 which rests upon a peripheral ledge formed in the vertical side walls 15*a*–15*c* and also along the bottom lip of the front opening. The purpose of shelf 29 is to hold the food load in spaced relationship to the bottom 14 and thus place the food load in desirable position with respect to the excitation modes within cavity 12.

As thus far described, oven 10 is of more or less conventional construction except for certain novel aspects of the combination of the microwave oven with the vent exhaust arrangement; the latter, however, not forming a part of the present invention.

In an actually constructed and operated embodiment of the oven of FIG. 1, it was found initially that the microwave energy level within cavity 12 was significantly higher in the left side region of the cavity than that found in the middle and right side regions. While the reason for this is not clearly understood, it was further found that the imbalance of energy levels could be significantly reduced and the distribution of energy within the cavity more evenly distributed by inserting a planar, metallic, electrically conductive surface, such as plate 32, within the cavity. Plate 32 is oriented parallel to the bottom wall 14 and is preferably spaced therefrom by a sufficient distance to support excitation modes between the plate and bottom. While the precise spacing is not thought to be critical, successful operation of the invention was achieved with spacings that ranged from a minimum of 7/16 inch to ½ inch. In a design intended for commerical production, a nominal spacing of 0.480 inches was adopted.

A limiting factor in how far up the plate may be spaced from the bottom 14 is the existence of the glass-ceramic shelf 29. As the plate was positioned closely adjacent the under side of the shelf, it was found that excessive cooking occurred in that portion of the food load that was closest to the shelf 29. This is believed to be as a result of microwave fields concentrated around the edges of the plate 32. It was further found that by keeping the plate 32 at least approximately ¼ inch below the shelf 29, this overheating effect was sufficiently alleviated as to not be a problem.

Figure 3:
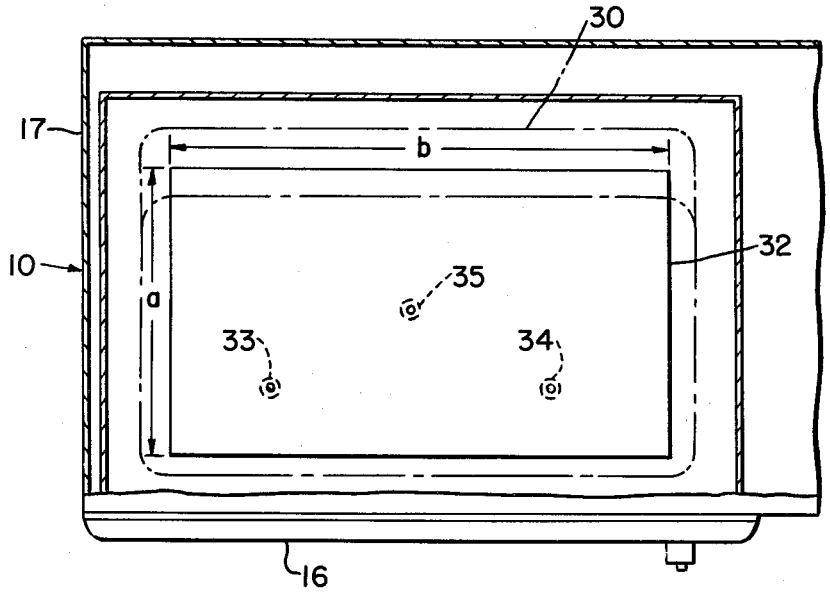
FIG. 3 is a top plan cross-sectional view of one embodiment of the present invention.

Referring to FIG. 3, depth and width dimensions "a" and "b" of plate 32 preferably are equal to an even and odd multiple, respectively, of λa/4. Successful results have been achieved using a plate with an "a" dimension of 6λa/4 (equal to 7.2 inches) and a "b" dimension of 11λa/4 (equal to 13.2 inches). The plate of this dimension was used in a cavity having internal dimensions of approximately 11 inches in depth, 16 inches in width, and 8¾ inches in height. As previously mentioned, the vertical side walls are shaped to form ledges 30 to support shelf 29. The shelf width is approximately ¾ inch and thus, with the foregoing dimensions of plate 32, its edges are spaced from the adjacent vertical side walls by approximately ¾ to 1 inch thus allowing coupling of the microwave energy into the space beneath the plate 32. As shown in FIG. 3, plate 32 is positioned symmetrically within the cavity such that the spacing from the side walls exists around all four sides of the plate 32. While this is a preferred arrangement, it has been found that plate 32 may be assymmetrically placed and can even be touching the vertical side wall in the "low energy" region of the cavity 12 without detriment, provided the edges of plate 32 remain spaced from the vertical side walls in the region of the cavity where the microwave energy level would be highest in the absence of the plate 32.

Preferably also, the plate 32 is spaced down from feed aperture 21 at an odd multiple of λa/4 and, in the aforementioned commercial design, a spacing of 8.3 inches was found to be satisfactory. The impedance reflected into the feed aperture 21 by plate 32 is highly reactive in value and is either inductive or capacitive depending on which side of the quarter wave point the plate is separated from the feed aperture. The reactance will display itself as a small resonance, within the band of 2450 MHz±50 HHz. As the plate is moved higher than the quarter wave point, the reflection is inductive and the plate resonant frequency increases. Below the quarter wave point, it decreases. For best results, the resonance should be on the low side if magnetrons of high center frequency are used and vice-versa.

Figure 4:
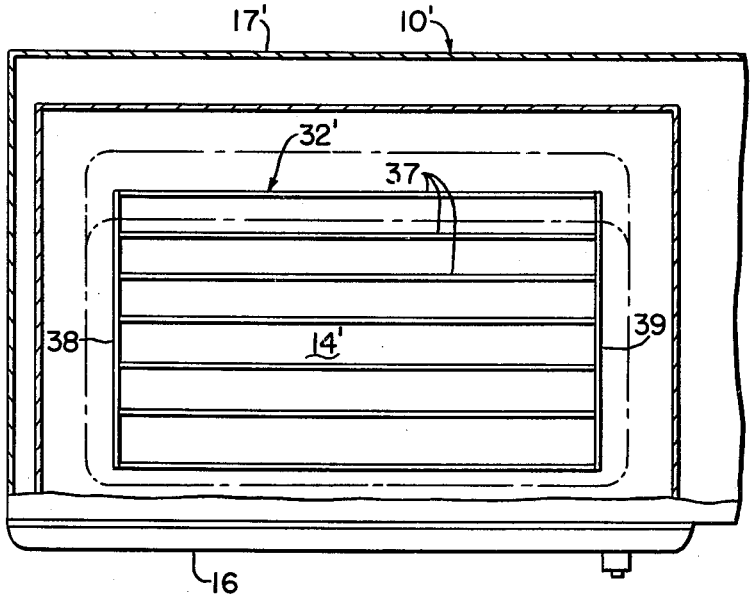
FIG. 4 is a top plan cross-sectional view of another embodiment of the present invention.

The plate dimensions are important from the standpoint of being large enough to obtain the correct edge to wall capacities on opposite sides of the plate so as to effect a shift in the energy within the oven cavity. The plate 32 must also be large enough to determine a reflective surface at least in one direction of electric field orientation. Thus, with reference to FIG. 4, within the scope of the present invention, the surface 32' might alternatively be comprised of closely spaced metal rods 37 running parallel to the direction of electric field in the direction that energy rebalancing is required. The ends of rods 37 are connected together by rods 38 and 39 so that capacity coupling to the vertical side walls can be accomplished. In this embodiment, the length of rods 37 are preferably approximately an odd multiple of λa/4 so as to prevent resonances from occurring due to transmission modes between the rods 37 or between the rods 37 and the bottom wall 14'.

Spacers 33–35 are preferably spaced at the null points of excitation modes beneath plate 32 so as to avoid heating and possible destruction thereof. In the embodiment of FIG. 1, spacers 33 and 34 are comprised of a suitable material such as molded polysulfone and positioned nominally 1.56 inches back from the front edge of plate 32 and 3.6 inches respectively on either side of the center of plate 32. Spacer 35 of this illustrated oven is comprised of aluminum and is positioned at the center of plate 32.

While, in accordance with the patent statutes, there has been described what at present is considered to be the preferred embodiment of the invention, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. In a microwave cooking oven having a microwave energy source, an interior cooking cavity including top, bottom and vertical side walls, and means including a feed aperture in the top wall for feeding the microwave energy from said source through the top wall into the cavity, an improvement for more evenly distributing microwave energy in the cavity comprising a metallic, electrically conductive, relatively thin, flat, rectangular plate oriented parallel to the bottom wall and spaced therefrom a sufficient distance to support microwave energy excitation between the underside of the plate and the cavity bottom wall, the edges of said plate being spaced from the vertical side walls at least in the region of said cavity where the microwave energy level would be highest in the absence of the conductive plate.

2. The improvement of claim 1 in which the front to back dimension of the plate is an even multiple of a quarter wavelength in free space of the microwave energy and the side-to-side dimension of the plate is an odd multiple of a quarter wavelength in free space of the microwave energy.

3. The improvement of claim 1 in which the conductive plate is spaced from the feed aperture a distance approximately equal to an odd multiple of a quarter wavelength in air of the microwave energy.

4. The improvement of claim 1 in which the plate is symmetrically positioned with respect to the vertical side walls with the edges of the plate spaced from all four side walls of the oven cavity.

5. The improvement of claim 1 in which the plate is assymetrically positioned with respect to the vertical side walls with one edge of the plate in contact with a side wall of the cavity remote from the region where the microwave energy would be highest in the absence of said plate.

6. The improvement of claim 1 in which the conductive plate is spaced from the bottom of the cavity by at least three spacers positioned in from the surface edge a minimum distance of at least three times a quarter wavelength in air of the microwave energy.

7. The improvement of claim 6 in which one spacer is positioned at the center of plate and two other spacers are positioned in from the edges of the plate at least approximately three quarter wavelengths in free space of the microwave energy.

* * * * *